US011439885B1

(12) United States Patent
Forney

(10) Patent No.: US 11,439,885 B1
(45) Date of Patent: Sep. 13, 2022

(54) GOLF PUTTING TRAINING DEVICES

(71) Applicant: Robert Forney, Johns Creek, GA (US)

(72) Inventor: Robert Forney, Johns Creek, GA (US)

( * ) Notice: Subject to any disclaimer, the term of this patent is extended or adjusted under 35 U.S.C. 154(b) by 0 days.

(21) Appl. No.: 17/366,125

(22) Filed: Jul. 2, 2021

Related U.S. Application Data

(60) Provisional application No. 63/160,294, filed on Mar. 12, 2021.

(51) Int. Cl.
*A63B 69/36* (2006.01)
*A63B 102/32* (2015.01)

(52) U.S. Cl.
CPC ..... *A63B 69/3685* (2013.01); *A63B 2102/32* (2015.10)

(58) Field of Classification Search
CPC ..... A63B 69/3685; A63B 2102/32
USPC ..... 473/219, 237, 238, 240, 251, 252, 253, 473/254
See application file for complete search history.

(56) References Cited

U.S. PATENT DOCUMENTS 760,161 A * 5/1904 Smith
3,273,892 A * 9/1966 Nolting ..... A63B 69/3685 473/238
3,273,893 A * 9/1966 Duncan ..... A63B 69/3685 473/238
3,758,117 A * 9/1973 Harrison ..... A63B 69/3632 473/231
3,951,415 A * 4/1976 Stuart ..... A63B 69/3685 473/238
4,170,356 A * 10/1979 Banks ..... A63B 69/3632 248/541
4,949,971 A * 8/1990 Thornton ..... A63B 69/3685 473/238
5,143,376 A * 9/1992 Johnson ..... A63B 69/3632 473/218
5,441,270 A * 8/1995 Williams ..... A63B 69/3632 473/242
7,258,622 B1 * 8/2007 Gaviria ..... A63B 69/3632 473/219
7,914,389 B2 * 3/2011 Burns ..... A63B 69/3685 473/238
8,740,718 B1 * 6/2014 Farris, III ..... A63B 69/3685 473/252
9,333,408 B1 * 5/2016 Hedrick ..... A63B 69/3632

* cited by examiner

*Primary Examiner* — Nini F Legesse

(57) ABSTRACT

Golf putting training devices are disclosed that include a body portion and a shaft attachment piece. The shaft attachment piece is connected to the body portion and is configured to attach the golf putting training device to a shaft of a putter. The golf putting training devices further include a shaft indicator surface, which is configured to rest adjacent to and along the shaft of the putter. In addition, the golf putting training devices include a sight alignment shield, which is connected to the body portion and is configured to be positioned perpendicular to the shaft indicator surface.

12 Claims, 3 Drawing Sheets

GOLF PUTTING TRAINING DEVICES

CROSS-REFERENCE TO RELATED APPLICATIONS

This application claims priority to, and incorporates by reference, U.S. provisional patent application Ser. No. 63/160,294, filed on Mar. 12, 2021.

FIELD OF THE INVENTION

The field of the present invention relates to golf putting training devices and, more specifically, the present invention relates to golf putting training devices that assist golfers with performing a consistent and proper putting stroke.

BACKGROUND OF THE INVENTION

Golfers often struggle to make a consistent and technically correct putting stroke. This is a challenge that is shared among professional, amateur, and recreational golfers alike. An inconsistent putting stroke is often caused by an improper use of a golfer's hands, wrists, and/or body motion (instead of a proper shoulder rotation or turn, with the hands and wrists remaining primarily inactive).

Various putting training devices have been developed and commercialized over the years. However, many of such currently-available devices are applied to a golfer's body and, when such devices are removed, golfers tend to resume improper hand, wrist, and/or body motions. Thus, a continuing need exists for improved, affordable, transportable, and easy-to-use putting training devices, which are better adapted to train a golfer to adopt a proper and consistent putting stroke.

As the following will demonstrate, the golf putting training devices described herein address such demands (and others) in the marketplace.

SUMMARY OF THE INVENTION

According to certain preferred aspects of the invention, golf putting training devices are provided. The devices generally include a body portion and a shaft attachment piece. The shaft attachment piece is connected to the body portion and is configured to attach the golf putting training device to a shaft of a putter. In certain exemplary and non-limiting embodiments, the shaft attachment piece may include a C-shaped concave area that is configured to wrap around and clamp to a portion of the putter shaft.

The golf putting training devices further include a shaft indicator surface, which is configured to rest adjacent to and run along the shaft of the putter (in a direction away from the golfer). In certain embodiments, the shaft indicator surface may include a bottom surface that is curved to match a circumference/outer contour of the putter shaft (i.e., such that a segment of the putter shaft may nestably reside adjacent to the bottom surface of the shaft indicator surface). In addition, the golf putting training devices include a sight alignment shield, which is connected to the body portion and is configured to be positioned perpendicular to the shaft indicator surface. The invention provides that the sight alignment shield will preferably exhibit a width that is greater than the width of the shaft indicator surface. In addition, the invention provides that the sight alignment shield will preferably exhibit a first color (e.g., black) that is different than a second color (e.g., red) of the shaft indicator surface.

According to certain additional aspects of the present invention, the golf putting training devices may further include a hinge fastener, which connects the sight alignment shield to the body portion of the training device. The hinge fastener is preferably configured to enable the sight alignment shield to be movable from a non-deployed position that is parallel with the shaft indicator surface to a deployed position that is perpendicular with the shaft indicator surface. In such embodiments, the body portion will preferably include a recessed area that is configured to receive the sight alignment shield (or portion thereof) when the sight alignment shield is converted to the non-deployed position.

The golf putting training devices of the present invention are used and operated by first attaching a device to the putter shaft—and positioning the sight alignment shield in the deployed position (perpendicular to the shaft indicator surface). If the golfer improperly uses his/her hands to perform a putting stroke (or otherwise executes other improper movements), particularly during his/her backswing, the shaft indicator surface will become visible to the golfer and viewable outside the boundary of the sight alignment shield; whereas, if the golfer executes a proper shoulder rotation to perform a putting stroke, the shaft indicator surface will remain hidden behind the sight alignment shield throughout the putting stroke and will not be visible to the golfer.

The above-mentioned and additional features of the present invention are further illustrated in the Detailed Description contained herein.

DETAILED DESCRIPTION OF THE INVENTION

Figure 1:
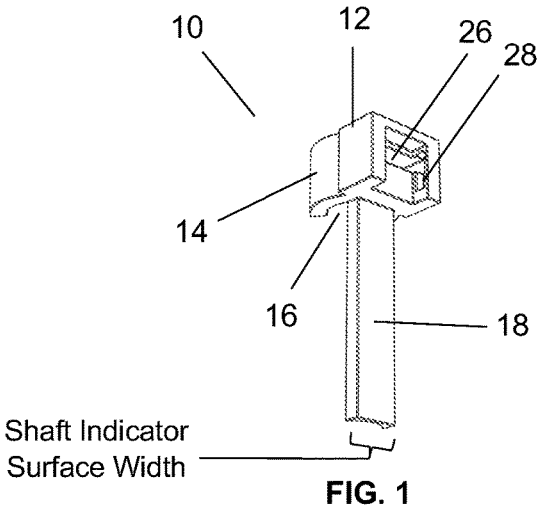
FIG. 1 is a bottom perspective view of the golf putter training device described herein (with the sight alignment shield removed from the device).
Figure 2:
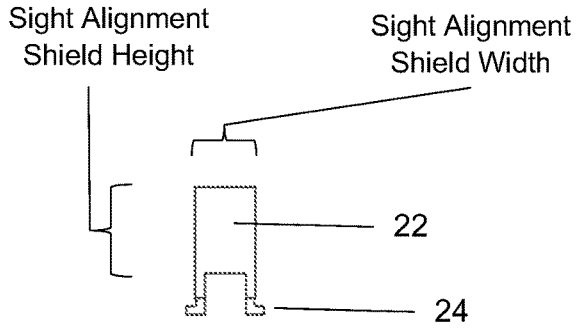
FIG. 2 is a front view of the sight alignment shield.
Figure 3:
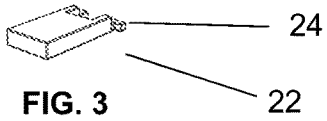
FIG. 3 is a top perspective view of the sight alignment shield.
Figure 4:
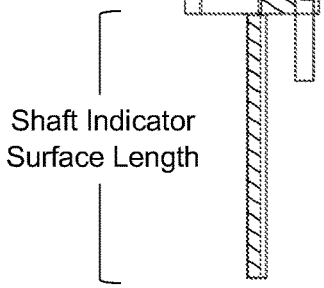
FIG. 4 is a cross-sectional left side view of the golf putter training device.
Figure 5:
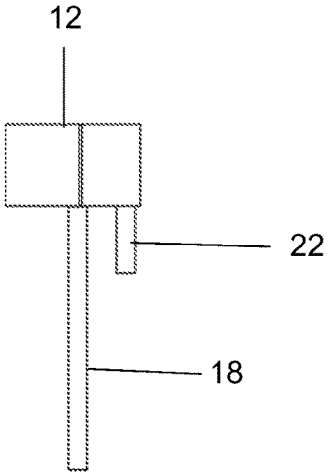
FIG. 5 is a left side view of the golf putter training device.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

According to certain preferred embodiments of the present invention, golf putting training devices are provided that are configured to train golfers to adopt correct and consistent putting strokes—and particularly putting strokes that involve proper shoulder rotation (and avoiding improper hand and wrist movement). More particularly, the golf putting training devices of the present invention are configured to be attached to the shaft of a golf putter—and to provide a golfer with visual keys that inform whether a proper stroke is being made or not.

Referring now to FIGS. 1-12, the golf putting training devices 10 include a body portion 12 and a shaft attachment piece 14. The shaft attachment piece 14 is connected to the body portion 12 and is configured to attach the golf putting training device 10 to a shaft of a putter. Preferably, the shaft attachment piece 14 is configured to attach the golf putting training device 10 to a shaft of a putter when the device 10 is being used, but to enable a golfer to quickly and easily remove the device 10 from the putter shaft when the device 10 is not in use. As used herein, the phrase "connected to" should be interpreted to mean, e.g., that the shaft attachment piece 14 is connected to, or integrally formed with, the body portion 12 of the training device 10. In certain embodiments, the shaft attachment piece 14 may include a C-shaped concave area 16 that is configured to tightly wrap around (or clamp to) a portion of the putter shaft. In such embodiments, the shaft attachment piece 14 is preferably attached to the putter shaft at a location where the shaft exhibits its smallest circumference, whereupon the training device 10 may then be manually slid up the putter shaft (which may exhibit a gradually increasing circumference) until the training device 10 is tightly connected to the putter shaft. In addition, the training device 10 should be rotated such that it is seated on the top of the putter shaft, relative a golfer holding the golf putter in an address position (see proper orientation in FIGS. 10-12).

Figure 10:
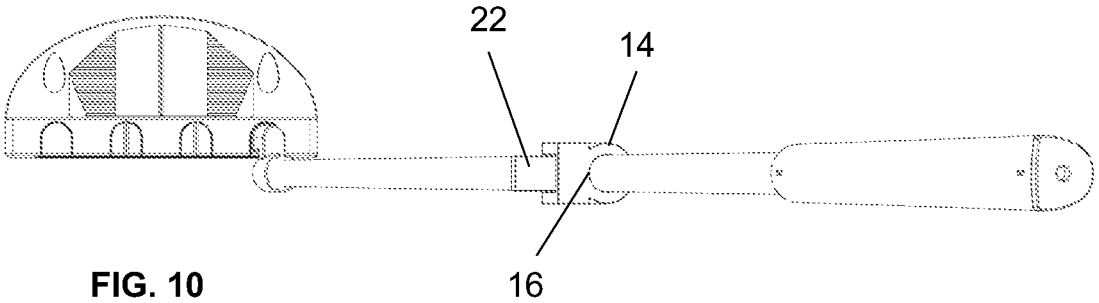
FIG. 10 is a top view of a golf putter, showing the golf putter training device attached to the shaft of the putter, with the sight alignment shield in a deployed position (such that the shaft indicator surface is hidden behind the sight alignment shield).
Figure 11:
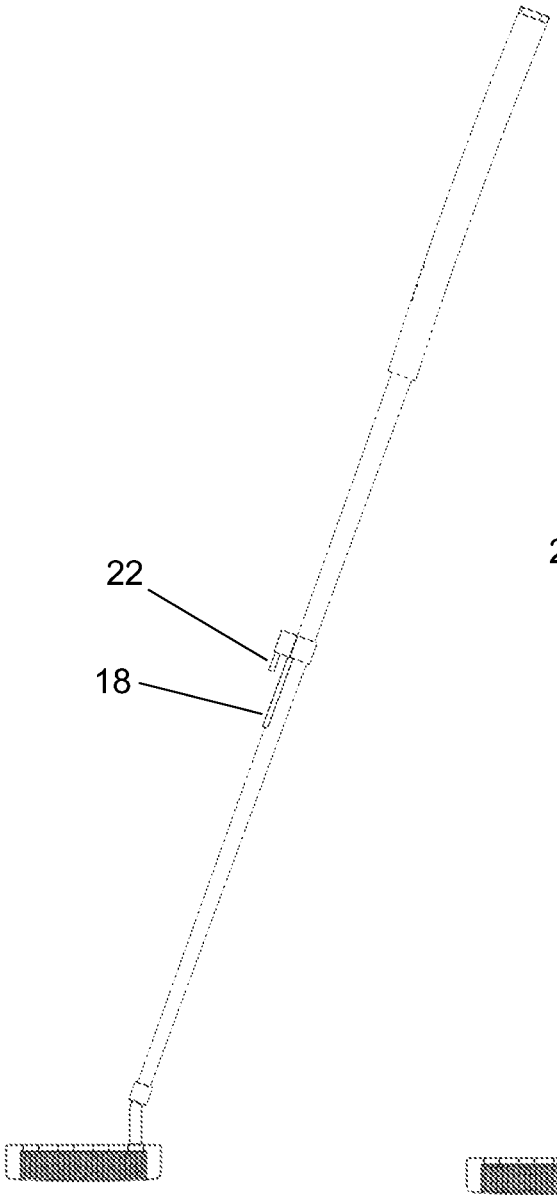
FIG. 11 is a front view of a golf putter, showing the golf putter training device attached to the shaft of the putter, with the sight alignment shield in a non-deployed position.
Figure 12:
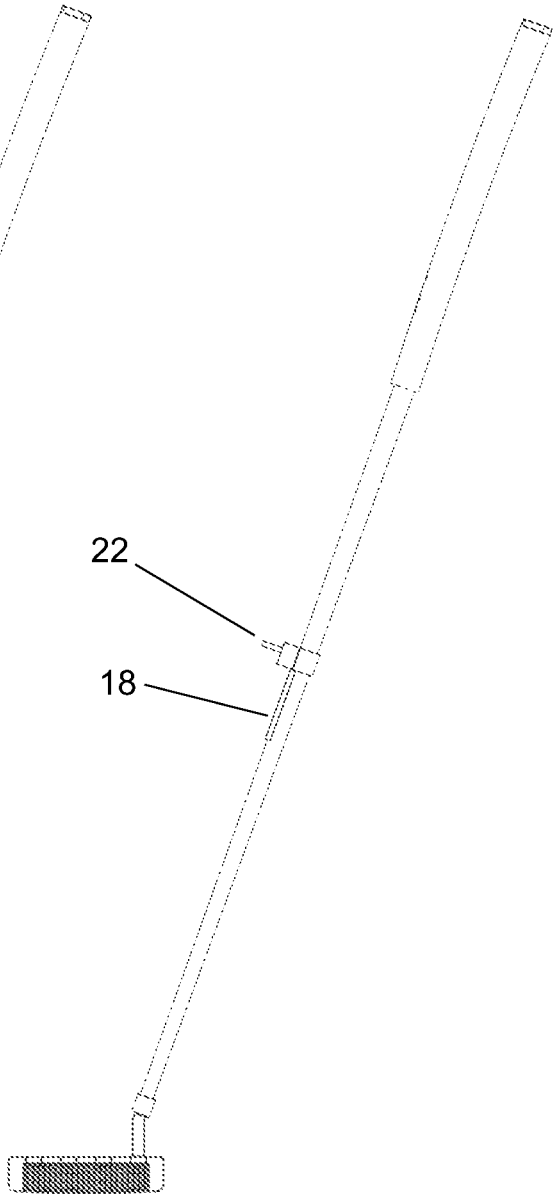
FIG. 12 is a front view of a golf putter, showing the golf putter training device attached to the shaft of the putter, with the sight alignment shield in a deployed position.

The golf putting training devices 10 further include a shaft indicator surface 18, which is configured to rest adjacent to and run along the shaft of the putter, with the shaft indicator surface 18 extending away from a golfer who is holding the putter at address (see FIGS. 10-12). In certain embodiments, the shaft indicator surface 18 may include a bottom surface 20 that is curved to match (or approximately match) a circumference/outer contour of the putter shaft. Although the shaft indicator surface 18 is illustrated herein to exhibit a rectangular shape, the shaft indicator surface 18 may exhibit other suitable shapes, such as oval shapes and others. In certain non-limiting embodiments of the present invention, the shaft indicator surface 18 may exhibit a length of about 50 mm and a width of about 11 mm.

In addition, the golf putting training devices 10 include a sight alignment shield 22—which may exhibit a rectangular shape, is connected to the body portion 12, and is configured to be positioned perpendicular to the shaft indicator surface 18 (FIGS. 6, 7, 9, and 12). The invention provides that the sight alignment shield 22 will preferably exhibit a width that is greater than the width of the shaft indicator surface 18. In certain non-limiting examples, the sight alignment shield 22 may exhibit a height (length) of about 25 mm and a width of about 12.5 mm. In addition, the invention provides that the sight alignment shield 22 will preferably exhibit a first color (e.g., black) that is different than a second color (e.g., red) of the shaft indicator surface 18.

Figure 6:
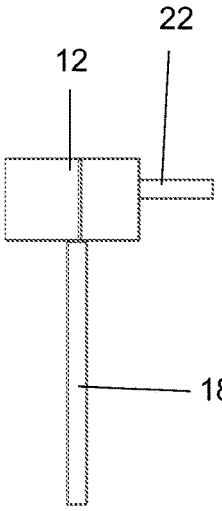
FIG. 6 is a right side view of the golf putter training device.
Figure 7:
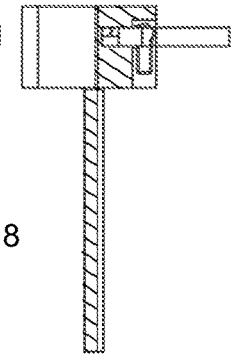
FIG. 7 is a cross-sectional right side view of the golf putter training device.
Figure 8:
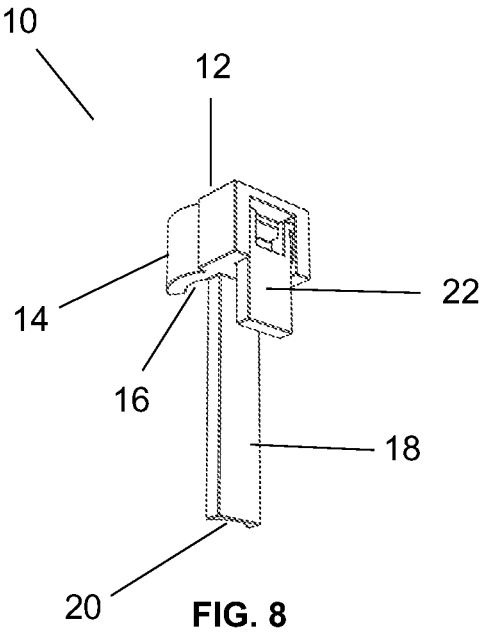
FIG. 8 is a bottom perspective view of the golf putter training device described herein, with the sight alignment shield in a non-deployed position.
Figure 9:
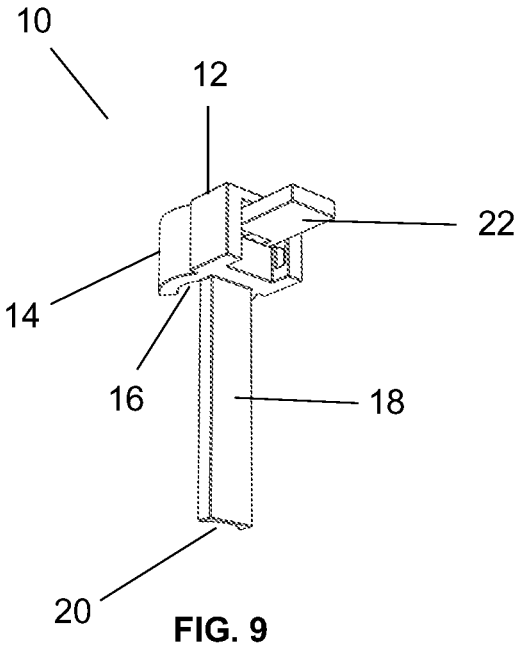
FIG. 9 is a bottom perspective view of the golf putter training device described herein, with the sight alignment shield in a deployed position.

According to certain additional embodiments of the present invention, the golf putting training devices 10 may further include a hinge fastener 24, which connects the sight alignment shield 22 to the body portion 12 of the training device 10—and is configured to enable the sight alignment shield 22 to be movable from a non-deployed position that is parallel with the shaft indicator surface 18 (FIGS. 4 and 5) to a deployed position that is perpendicular with the shaft indicator surface 18 (FIGS. 6 and 7). In such embodiments, the body portion 12 will preferably include a recessed area 26 that is configured to receive the sight alignment shield 22 (or portion thereof) when the sight alignment shield 22 is converted to the non-deployed position. When in use, the sight alignment shield 22 is rotated 90-degrees to the deployed position, such that the sight alignment shield 22 is perpendicular with the shaft indicator surface 18. When not in use, the sight alignment shield 22 may be rotated and positioned within the recessed area 26 to the non-deployed position, such that the sight alignment shield 22 is parallel with the shaft indicator surface 18. In such embodiments, the hinge fastener 24 may consist of two feet or protruding elements, which are configured to be inserted into a pair of apertures 28 located within the recessed area 26, such that the sight alignment shield 22 is able to rotate about the two feet or protruding elements within the apertures 28 by 90-degrees to the deployed and non-deployed positions shown and described herein.

The training device 10 of the present invention is used and operated by first attaching the device 10 to the putter shaft, as described above and illustrated in FIGS. 10-12. If the golfer improperly uses his/her hands to perform a putting stroke (or otherwise executes other improper movements), the shaft indicator surface 18 will become visible to the golfer—i.e., the shaft indicator surface 18 will be viewable outside the confines of the sight alignment shield 22. If the golfer executes a proper shoulder rotation to perform a putting stroke (and does not utilize improper hand or wrist motion), the shaft indicator surface 18 will remain hidden behind the sight alignment shield 22 throughout the golfer's putting stroke—and will not be visible to the golfer—as illustrated in FIG. 10.

The training devices 10 may be manufactured from plastic, elastomers, metals, and/or other rigid materials—e.g., a may be produced via injection molding, 3D printing, or other manufacturing procedures. In addition, the invention provides that although the training devices 10 of the present invention are adapted to assist golfers in making a proper putting stroke, the devices 10 may also be used to train a golfer to execute a proper takeaway motion with other golf clubs, such as irons, woods, and drivers.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A golf putting training device, which comprises:

(a) a body portion;

(b) a shaft attachment piece, which is connected to the body portion and is configured to attach the golf putting training device to a shaft of a putter;

(c) a shaft indicator surface, which is configured to rest adjacent to and along the shaft of the putter, wherein the shaft indicator surface extends away from a golfer who is holding the putter at address; and (d) a sight alignment shield, which is connected to the body portion and is configured to be positioned perpendicular to the shaft indicator surface, wherein the golf putting training device is configured to be attached to the shaft of the putter at a location such that the shaft indicator surface is completely hidden behind the sight alignment shield when the golfer is holding the putter at address.

2. The golf putting training device of claim 1, which further comprises a hinge fastener, which (i) connects the sight alignment shield to the body portion and (ii) is configured to enable the sight alignment shield to be movable from a non-deployed position that is parallel with the shaft indicator surface to a deployed position that is perpendicular with the shaft indicator surface.

3. The golf putting training device of claim 2, wherein the sight alignment shield has a width that is greater than a width of the shaft indicator surface.

4. The golf putting training device of claim 3, wherein the sight alignment shield exhibits a first color that is different than a second color of the shaft indicator surface.

5. The golf putting training device of claim 4, wherein the body portion includes a recessed area that is configured to receive the sight alignment shield, or a portion of the sight alignment shield, when the sight alignment shield is converted to the non-deployed position.

6. The golf putting training device of claim 5, wherein the shaft attachment piece comprises a C-shaped concave area that is configured to wrap around a portion of the shaft of the putter.

7. The golf putting training device of claim 6, wherein a bottom surface of the shaft indicator surface is curved to match an outer contour of the shaft of the putter.

8. The golf putting training device of claim 2, wherein the sight alignment shield exhibits a first color that is different than a second color of the shaft indicator surface.

9. The golf putting training device of claim 2, wherein the body portion includes a recessed area that is configured to receive the sight alignment shield, or a portion of the sight alignment shield, when the sight alignment shield is converted to the non-deployed position.

10. The golf putting training device of claim 2, wherein the shaft attachment piece comprises a C-shaped concave area that is configured to wrap around a portion of the shaft of the putter.

11. A golf putting training device, which comprises:

(a) a body portion;

(b) a shaft attachment piece, which (i) is connected to the body portion and (ii) comprises a C-shaped concave area that is configured to wrap around a portion of a shaft of a putter;

(c) a shaft indicator surface, which (i) is configured to rest adjacent to and along the shaft of the putter, wherein the shaft indicator surface extends away from a golfer who is holding the putter at address, and (ii) includes a bottom surface that is curved to match an outer contour of the shaft of the putter;

(d) a sight alignment shield, which is connected to the body portion and is configured to be movable from a non-deployed position that is parallel with the shaft indicator surface to a deployed position that is perpendicular with the shaft indicator surface; and (e) a hinge fastener, which is configured to enable the sight alignment shield to be movable from the non-deployed position to the deployed position, wherein:

(i) the sight alignment shield has a width that is greater than a width of the shaft indicator surface;

(ii) the sight alignment shield exhibits a first color that is different than a second color of the shaft indicator surface; and (iii) the body portion includes a recessed area that is configured to receive the sight alignment shield, or a portion of the sight alignment shield, when the sight alignment shield is converted to the non-deployed position, wherein the golf putting training device is configured to be attached to the shaft of the putter at a location such that the shaft indicator surface is completely hidden behind the sight alignment shield when the golfer is holding the putter at address.

12. A golf putter with a golf putting training device attached to a shaft of said golf putter, wherein the golf putting training device comprises:

(a) a body portion;

(b) a shaft attachment piece, which (i) is connected to the body portion and (ii) comprises a C-shaped concave area that is configured to wrap around a portion of the shaft of the putter;

(c) a shaft indicator surface, which (i) is configured to rest adjacent to and along the shaft of the putter, wherein the shaft indicator surface extends away from a golfer who is holding the golf putter at address, and (ii) includes a bottom surface that is curved to match an outer contour of the shaft of the golf putter;

(d) a sight alignment shield, which is connected to the body portion and is configured to be movable from a non-deployed position that is parallel with the shaft indicator surface to a deployed position that is perpendicular with the shaft indicator surface; and (e) a hinge fastener, which is configured to enable the sight alignment shield to be movable from the non-deployed position to the deployed position, wherein:

(i) the sight alignment shield has a width that is greater than a width of the shaft indicator surface;

(ii) the sight alignment shield exhibits a first color that is different than a second color of the shaft indicator surface; and (iii) the body portion includes a recessed area that is configured to receive the sight alignment shield, or a portion of the sight alignment shield, when the sight alignment shield is converted to the non-deployed position, wherein the golf putting training device is attached to the shaft of the golf putter at a location such that the shaft indicator surface is completely hidden behind the sight alignment shield when the golfer is holding the golf putter at address.

* * * * *